US005769208A

United States Patent [19]

Griffith

[11] Patent Number: 5,769,208

[45] Date of Patent: Jun. 23, 1998

[54] LOCKABLE ASSEMBLY FOR ENGAGING AND DISENGAGING A MOTOR OPERATOR WITH AN OVERHEAD DISTRIBUTION GANG SWITCH

[76] Inventor: Charles E. Griffith, 112121 Whisperwood La., Rockville, Md. 20852

[21] Appl. No.: 758,450

[22] Filed: Nov. 29, 1996

[51] Int. Cl.[6] ..... H01H 31/00

[52] U.S. Cl. ..... 200/48 R; 200/48 A; 200/321

[58] Field of Search ..... 200/48 R, 48 A, 200/48 V, 49, 321, 322

[56] References Cited

U.S. PATENT DOCUMENTS

| | | | |
|---|---|---|---|
| 3,043,924 | 7/1962 | Johnson | 200/48 R |
| 3,089,006 | 5/1963 | Thallner | 200/48 R |
| 3,126,756 | 3/1964 | Bertling . | |
| 3,189,698 | 6/1965 | Johnson . | |
| 3,760,920 | 9/1973 | Delfeld . | |
| 4,210,788 | 7/1980 | Stranczek . | |

*Primary Examiner*—David J. Walczak
*Attorney, Agent, or Firm*—Spencer & Frank

[57] ABSTRACT

An apparatus used in combination with a motor operator and an overhead distribution gang switch. The motor operator is activatable for automatically opening and closing the gang switch. The locking assembly includes a coupler assembly that couples the motor operator with the gang switch. A clutch plate and operating handle connecting device is hinged to the coupler assembly for selectively connecting and disconnecting the motor operator with the gang switch, and for manually opening and closing the gang switch when the motor operator and the gang switch are disconnected. An assembly is provided for locking the coupler assembly in a coupled mode. A locking device is engageable with the connecting device when the motor operator and the gang switch are disconnected. The locking device locks the connecting device in a first position in which the gang switch is opened, and locks the connecting device in a second position in which the gang switch is closed.

18 Claims, 11 Drawing Sheets

LOCKABLE ASSEMBLY FOR ENGAGING AND DISENGAGING A MOTOR OPERATOR WITH AN OVERHEAD DISTRIBUTION GANG SWITCH

BACKGROUND OF THE INVENTION

The present invention relates to an apparatus that is used in combination with a motor operator and an overhead distribution gang switch, wherein the motor operator is electrically activatable for automatically or remotely opening and closing the gang switch.

Electric companies frequently use gang switches in distribution systems which supply electric power to customers. A typical application for a gang switch in a power distribution system is to permit one portion of a high-voltage, three phase trunk to be isolated from the rest of the power distribution system so that technicians can work on the isolated portion of the trunk in safety.

Motor operators connected to gang switches are known, for example, from U.S. Pat. No. 3,189,698. In this patent, the motor is connected via a shaft to a gang of switch units. When the motor is activated, the associated shaft is rotated about its axis, thus causing the switch units to open or close.

Currently, overhead gang switches are automatically and remotely operated using motor operators and associated packet radios. This allows for rapid sectionalizing and restoration in a process known as distribution automation. However, it is also beneficial if the gang switches can be manually operated, if for example, the motor operator becomes inoperative. To manually operate a gang switch connected to a motor operator, it thus becomes necessary to decouple the gang switch from the motor operator.

Devices that allow for the uncoupling of a switch from a motor are known from, for example, U.S. Pat. No. 3,126,756. In this patent, a device is disclosed that allows a switch, mounted on a wooden pole at a considerable height above the ground, to be opened and closed from the ground using a gear reduction mechanism. This patent further discloses that it may be necessary to uncouple the gear reduction mechanism from the switch, so that the switch can be manually opened and closed. In order to accomplish this objective, a shaft assembly is provided that includes a main shaft whose upper end is affixed to the switch, and an auxiliary shaft telescopically received within the main shaft, and whose lower end is keyed to the gear reduction mechanism. To uncouple the shaft assembly from the gear reduction mechanism, a handle is pivoted, which through a linkage assembly, raises the auxiliary shaft out from the gear reduction mechanism, so that the switch can be manually opened and closed by swinging the handle in a plane normal to the axis of the shaft assembly.

Due to Occupational Safety and Health Administration (OSHA) regulations, when a power line is to be worked upon, it is first necessary to open all switches that may provide electricity to the power line. These opened switches are then, by OSHA regulation, locked in position, and tagged with the individual's name who opened the switch. This individual is then the only person who is allowed to remove the tag, which provides a theoretically safe method of protecting the lineman from possible electrocution. This is known as "lockout tagout". It is thus necessary to provide a means for locking the switch in the desired position, and tagging the locked switch.

As disclosed by U.S. Pat. No. 4,210,788, it is known in the art of manually operated switch handles to make them padlockable in one or the other extreme operating positions.

This patent further discloses an interlocking device that includes a first mechanical interlock that prevents any movement of a handle assembly, and a second mechanical interlock that prevents movement of the handle assembly to close an interrupter device except in certain operating conditions.

SUMMARY OF THE INVENTION

It is an object of the present invention to provide an improved assembly for connecting and disconnecting a motor operator with an overhead distribution gang switch.

It is a further object of the present invention to provide a padlocking means that will lock the gang switch in both its opened position and its closed position, when the motor operator and the gang switch are decoupled.

It is another object of the present invention to provide a locking device that is universal and self contained, so as to accommodate gang switches and motor operators of different types.

It is an additional objective of the present invention to provide a locking means that makes it readily visually apparent that the motor operator is decoupled from the gang switch, and that the switch is opened or closed.

The above and other objects are accomplished according to the invention by providing a coupler assembly that couples the motor operator with the gang switch. A means is provided for padlocking the coupler assembly in the coupled mode. An operating handle is attached to the coupler assembly for selectively coupling and decoupling the motor operator with the gang switch, and for manually opening and closing the gang switch when the motor operator and the gang switch are decoupled. Padlocking means are engageable with the operating handle when the motor operator and the gang switch are decoupled. The locking means lock the operating handle in a first position in which the gang switch is opened, and lock the operating handle in a second position in which the gang switch is closed.

The invention will be described below in greater detail in connection with an embodiment thereof that is illustrated in the drawing figures.

DETAILED DESCRIPTION OF THE INVENTION

Figure 1:
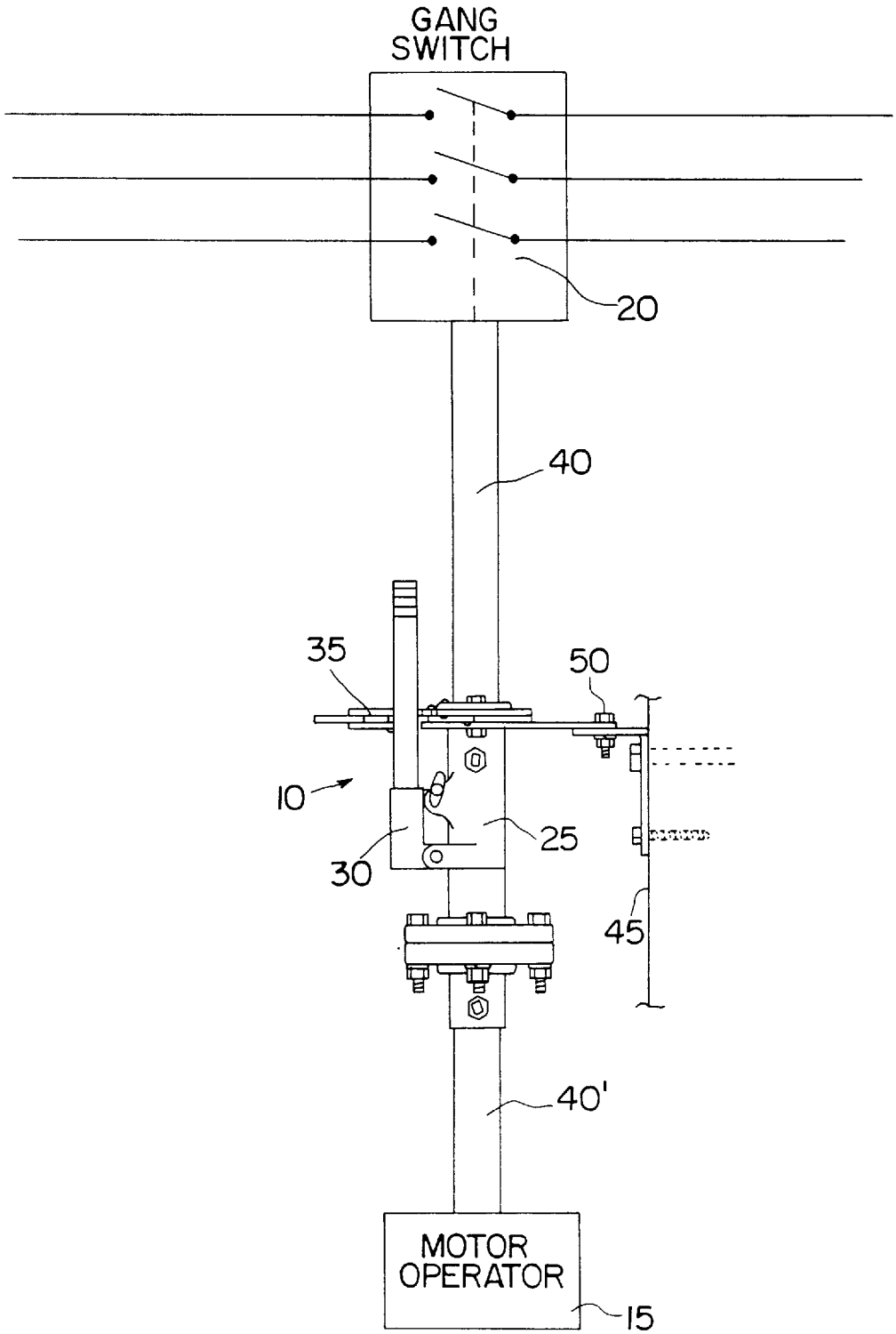
FIG. 1 is an elevational view of the apparatus according to the present invention connected to a gang switch and a motor operator.

Referring to FIG. 1, a lockable engagement/disengagement assembly 10 according to the present invention is illustrated. As shown, the assembly 10 is connected between a known motor operator 15 and a known overhead distribution gang switch 20. The motor operator 15 is activatable for automatically opening and closing the gang switch.

The assembly 10, in general, includes a coupler assembly 25 that selectively couples the motor operator 15 with the gang switch 20. An operating handle and clutch plate assembly 30 is attached to the coupler assembly 25 that cooperates with the coupler assembly for the selective connecting and disconnecting of the motor operator 15 with the gang switch 20, and for manually opening and closing the gang switch when the motor operator and the gang switch are decoupled. A locking apparatus 35 is engageable with the operating handle of the assembly 30 when the motor operator 15 and the gang switch 20 are disengaged. The locking apparatus 35 locks the operating handle of assembly 30 in a first position in which the gang switch is opened, and locks the operating handle of the assembly 30 in a second position in which the gang switch is closed.

As shown, the motor operator 15 includes an operating shaft 40', and the gang switch 20 includes an operating shaft 40. The motor operator and gang switch are connected to the assembly 10 using operating shafts 40, 40'. The assembly 10, as will be described later in greater detail, either connects shaft 40 with shaft 40', so that the shafts can rotate about their axis as one shaft, or separates shaft 40 from shaft 40', so that either shaft may be axially rotated without rotating the other shaft.

Typically, the assembly 10 is connected to a pole or a beam 45 using an attachment assembly 50. As is known, the switch 20 is usually attached to an upper end (not shown) of the pole 45, so as to keep the power lines away from the ground. The motor operator 15 and assembly 10 are preferably placed near the ground, at a lower end of the pole 45, so that they may be easily accessed by a worker.

Figure 2:
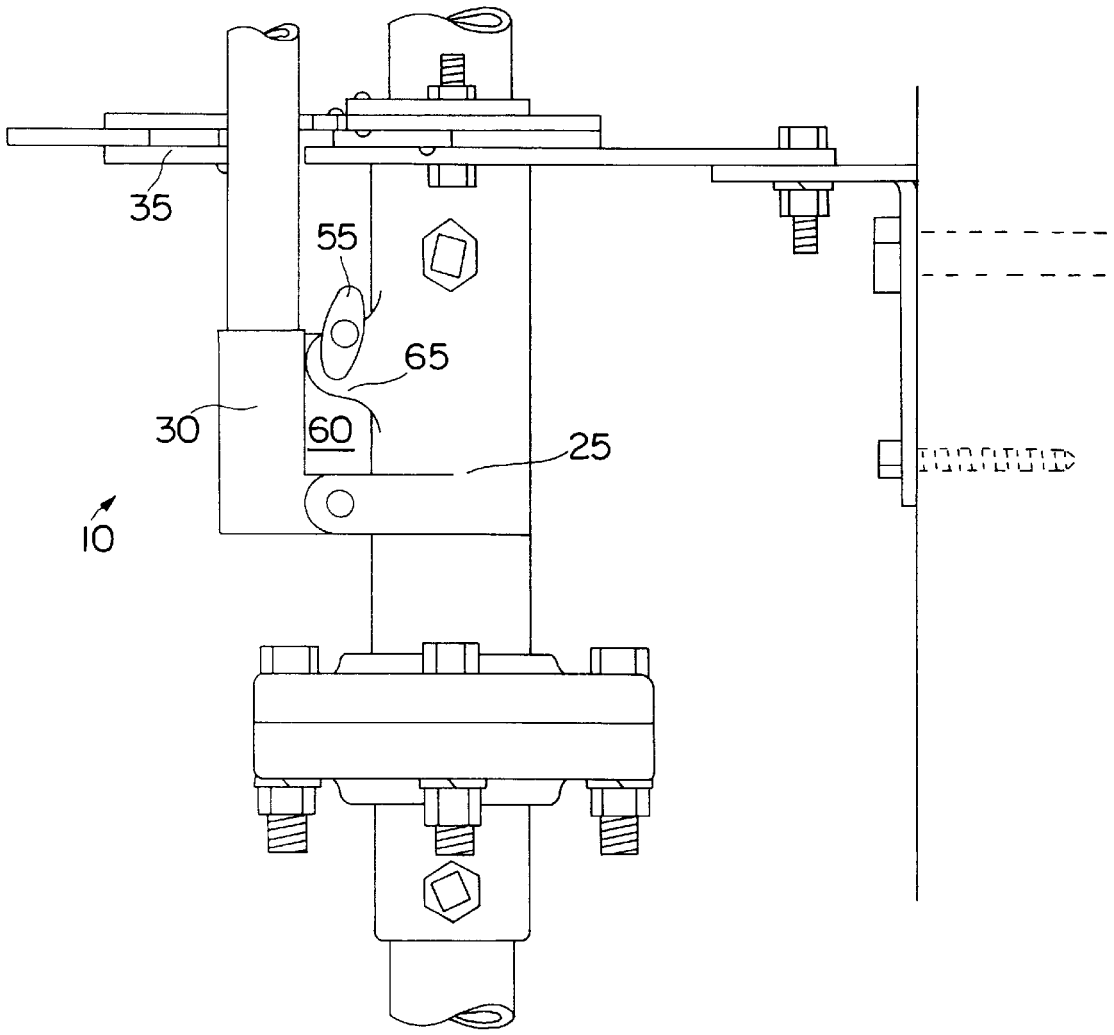
FIG. 2 is a side elevational view of the apparatus according to the present invention, with the assembly being locked in a position whereby the motor operator is coupled with the gang switch.
Figure 3:
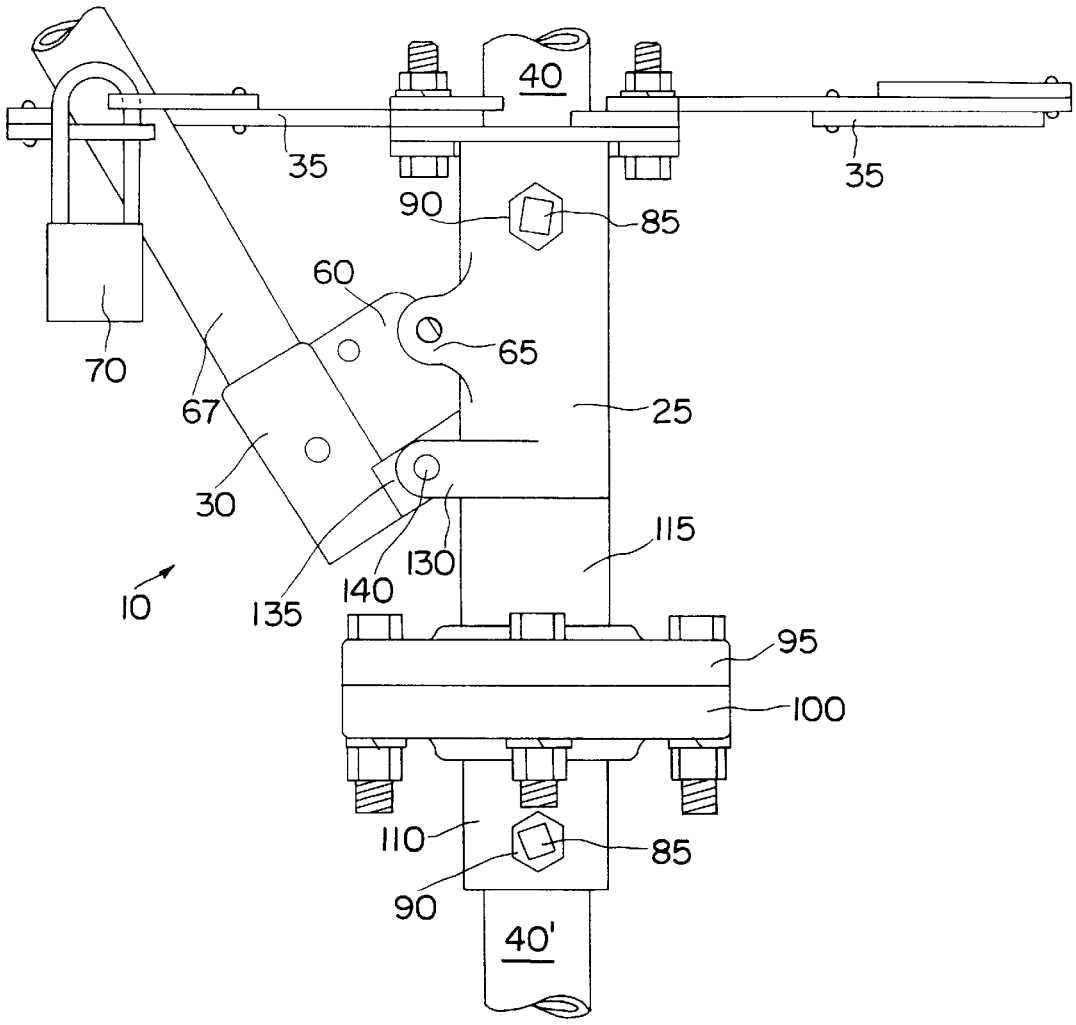
FIG. 3 is a front elevational view of the apparatus according to the present invention, with the assembly being locked in a position whereby the motor operator is disconnected from the gang switch, and the gang switch is closed.
Figure 4:
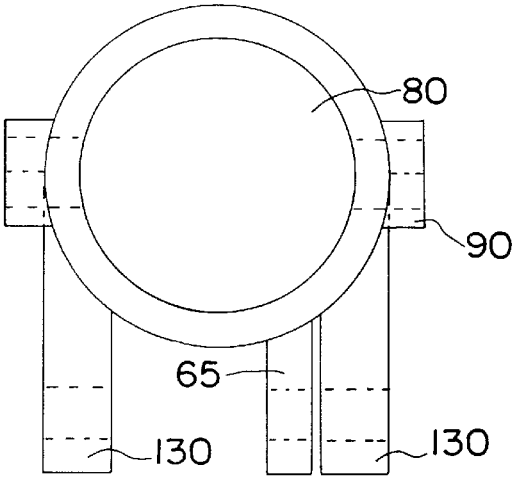
FIGS. 4–6 are a plan view, side elevational view, and front elevational view, respectively, of a component of the coupler assembly according to the present invention.

Referring to FIGS. 2 and 3, a side elevational view and a front elevational view, respectively, of the assembly 10 according to the present invention are shown. In FIG. 2, the assembly 10 is locked with a padlock 55 in a position whereby the motor operator is connected with the gang switch. As shown, the shackle of padlock 55 projects through a clutch plate 60 of the operating handle and clutch plate assembly 30, and projects through a tongue 65 of the coupler assembly 25, thus locking the operating handle and clutch plate assembly to the coupler assembly. As shown, both the tongue 65 and the clutch plate 60 have a hole therethrough, so that when the assembly 10 is in the position shown in FIG. 2, the holes are aligned for accommodating the padlock 55.

In FIG. 3, the assembly 10 is locked in a position whereby the motor operator is decoupled from the gang switch, and the gang switch is closed. As shown, in this position, the clutch plate 60 is not locked to the tongue 65. Instead, handle 67 of the operating handle and clutch plate assembly 30 is locked to the locking apparatus 35 using a padlock 70. In FIG. 3, the position is such that the gang switch is closed. However, if the handle 67 were locked to the portion of the locking apparatus 35 shown in the right hand side of the figure, the gang switch would be in an opened position.

Referring additionally to FIGS. 4–10, the coupler assembly 25 is shown in detail. In general, the coupler assembly 25 includes two shafts 75, 80, one of which is connected to the motor operator, and the other of which is connected to the gang switch. One of the shafts (in these Figures, shaft 80), is a sleeve, and receives the other shaft (in these Figures, shaft 75) therein. Once shaft 75 is received within shaft 80, the two shafts may axially rotate relative to one another.

In particular, and referring to FIGS. 3–6, shaft 80 is typically connected to the gang switch, using shaft 40 which can be received within the upper end of shaft 80, and affixed thereto using, for example, piercing screws 85 that are located within nuts 90. Alternatively, the shaft 80 could be welded or clamped to the shaft 40. In this manner, axial rotation of the shaft 80 will cause an axial rotation of the shaft 40, thus causing the gang switch to either open or close.

In a similar manner, and as best shown in FIGS. 3 and 7–10, shaft 75 is connected to the motor operator, using shaft 40'. In order to increase the ease of installation of the assembly 10, the shaft 75 is preferably connected at its lower end, using for example, rivets 93, with a flange 95, which is fastened to a further flange 100. Further flange 100 includes a sleeve portion 110, for receiving the shaft 40' therein. Shaft 40' can then be affixed to the sleeve portion 110 (and thus to the shaft 75) using, for example, piercing screws 85 that are located within nuts 90. Alternatively, the shaft 75 could be directly welded or clamped to the shaft 40', thus eliminating the two flanges. In this manner, activation of the motor operator will cause an axial rotation of the shaft 40', thus causing an axial rotation of the shaft 75.

In order to accurately position the shaft 75 within the shaft 80, shaft 75 is provided at its lower end with a bushing 115. As shown, bushing 115 is concentrically arranged around the exterior surface of the shaft 75. Thus, when shaft 75 is received within the shaft 80, bushing 115 abuts against the end of shaft 80, so that shaft 75 will be longitudinally positioned in a predetermined location. As will be subsequently described, this positioning is necessary in order to fixedly connect the motor operator to the gang switch.

Figure 5:
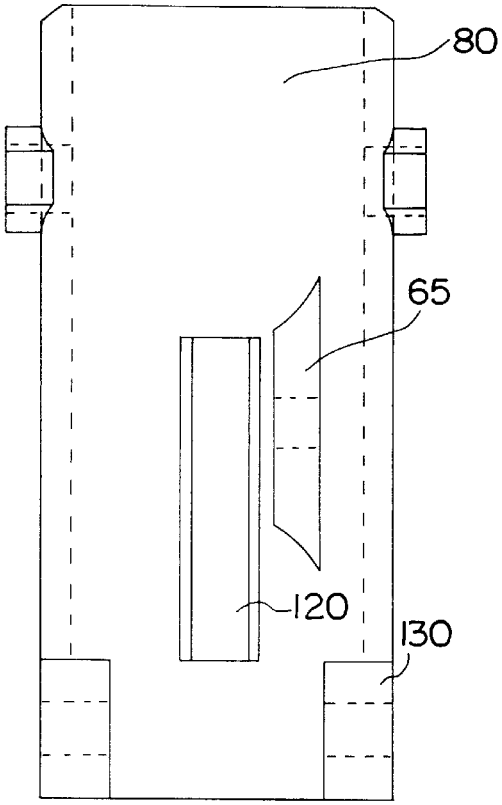
Figure 6:
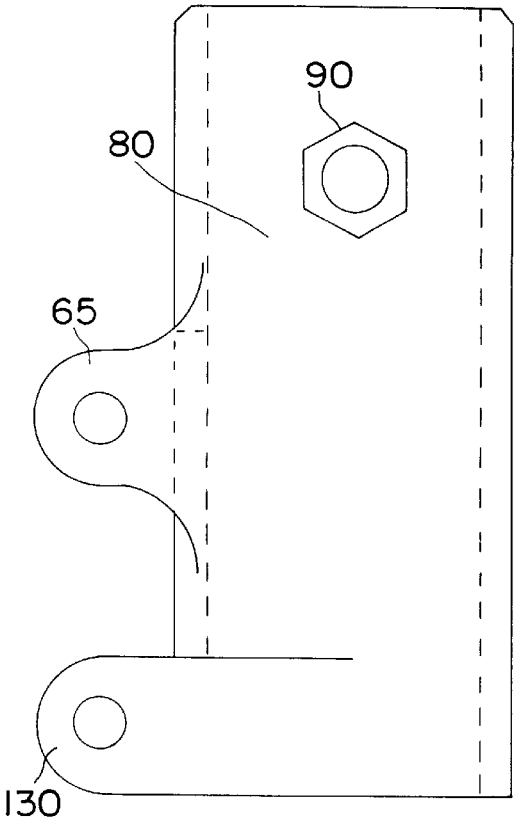
Figure 8:
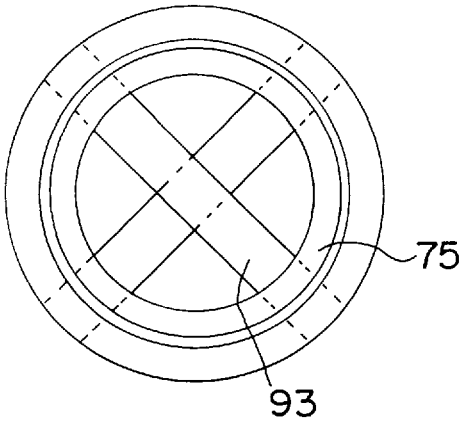
FIG. 8 is a plan view of a portion of the component shown in FIG. 7.
Figure 7:
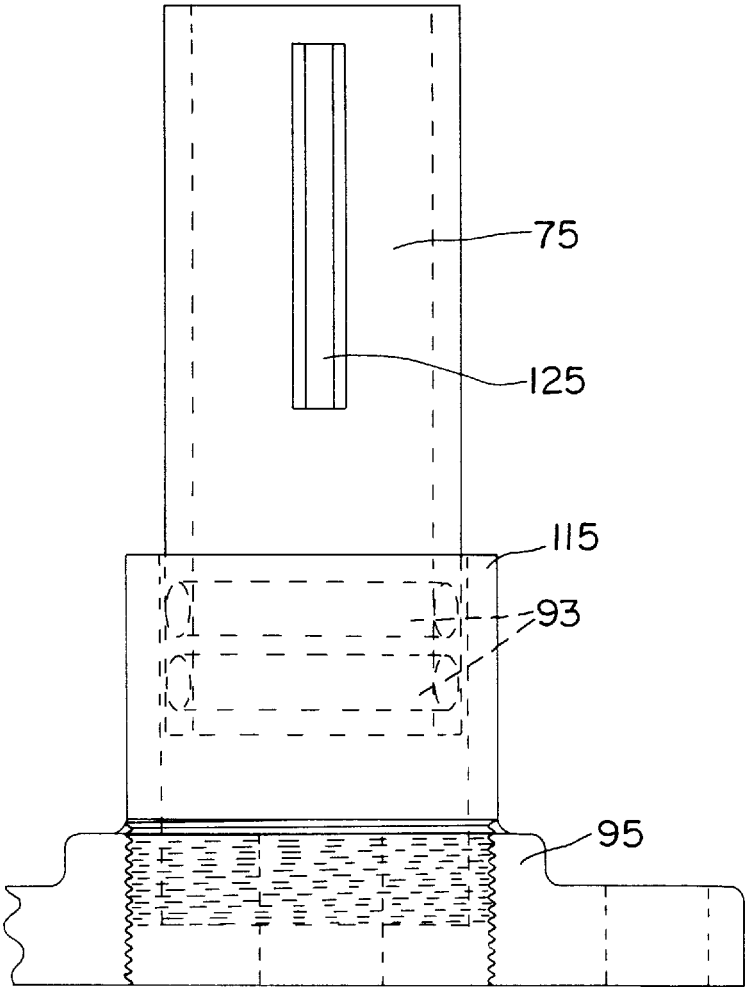
FIG. 7 is an elevational view of the mating component of the coupler assembly according to the present invention.
Figure 9:
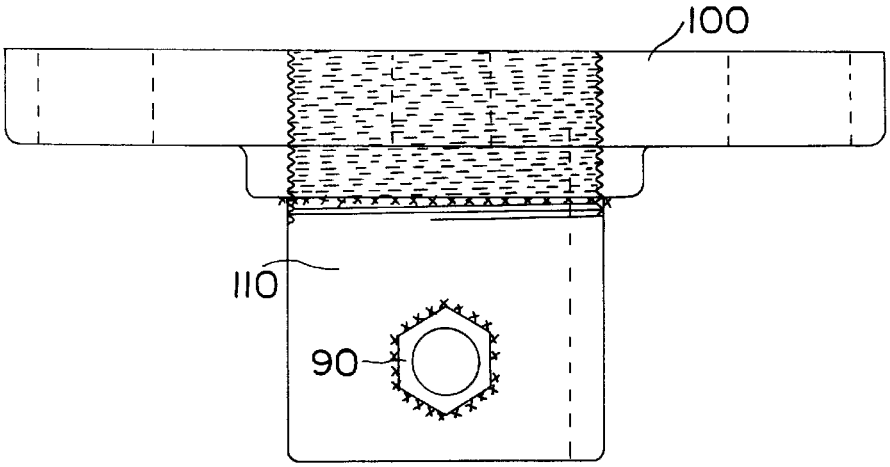
FIG. 9 is an elevational view of an additional coupling component of the coupler assembly to facilitate installation according to the present invention.
Figure 10:
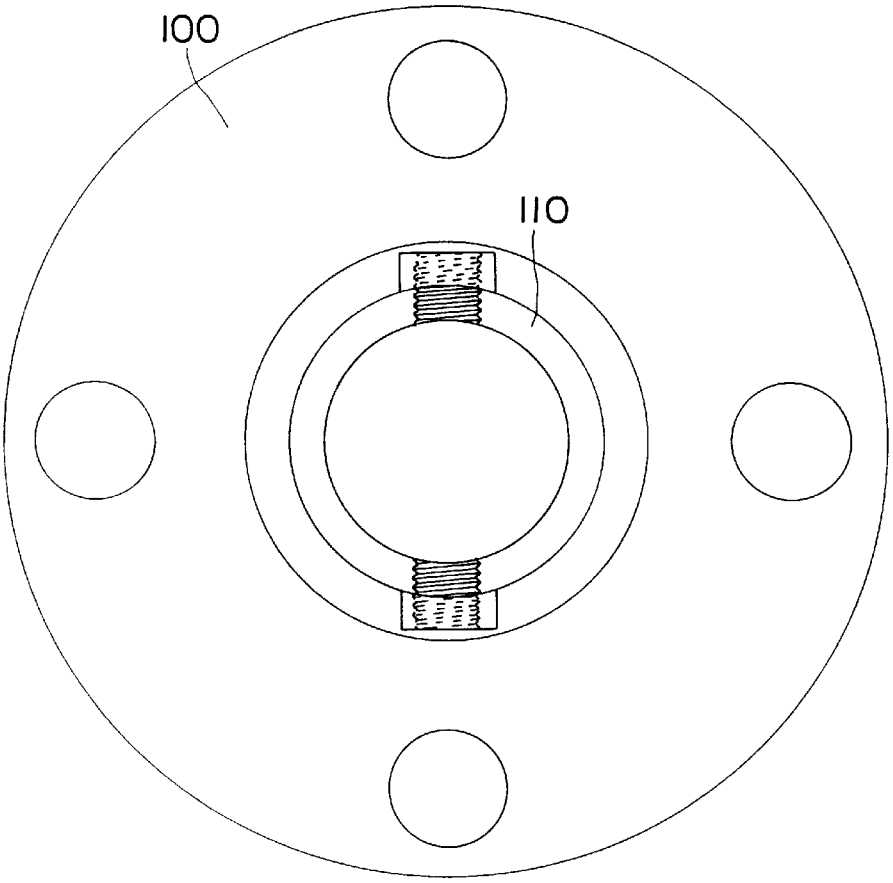
FIG. 10 is a plan view of the component shown in FIG. 9.

As shown in FIG. 5, the shaft 80 includes a longitudinally arranged slot 120 that is formed in its wall, and is positioned adjacent to the tongue 65. Similarly, and as shown in FIG. 7, shaft 75 includes a slot 125. When shaft 75 is received within the shaft 80, and is longitudinally positioned in its predetermined location, the two shafts are axially rotatable relative to one another. During their rotation, the two slots 120, 125 will become aligned. In this position, the two slots can then receive the clutch plate 60, thus affixing the shaft 75 to the shaft 80, and thereby connecting the motor operator to the gang switch.

As best shown in FIGS. 3 and 4–6, shaft 80 includes a pair of hinges 130, each being located below, and on either side of, the slot 120. Hinges 130 pivotally receive a bracket 135 of the operating handle and clutch plate assembly, and allow the handle 67 and clutch plate 60' to be pivoted towards and away from the shaft 80. Typically, the bracket 135 is hinged to the hinges 130 using a hinge pin 140.

Figure 11:
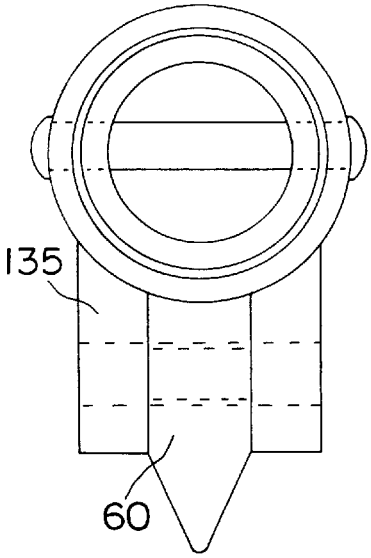
FIGS. 11–13 are a plan view, side elevational view, and front elevational view, respectively, of the operating handle and clutch plate components of the connecting assembly according to the present invention.
Figure 13:
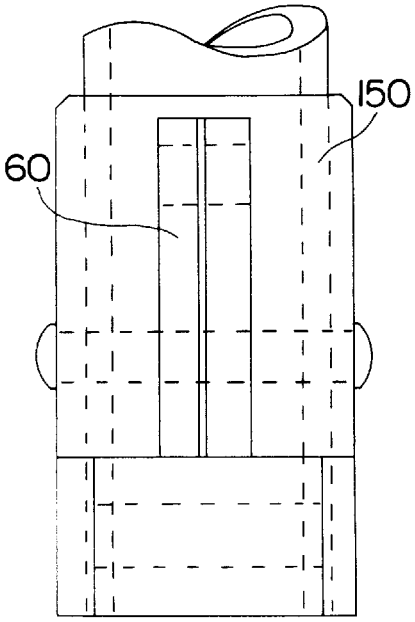
Figure 12:
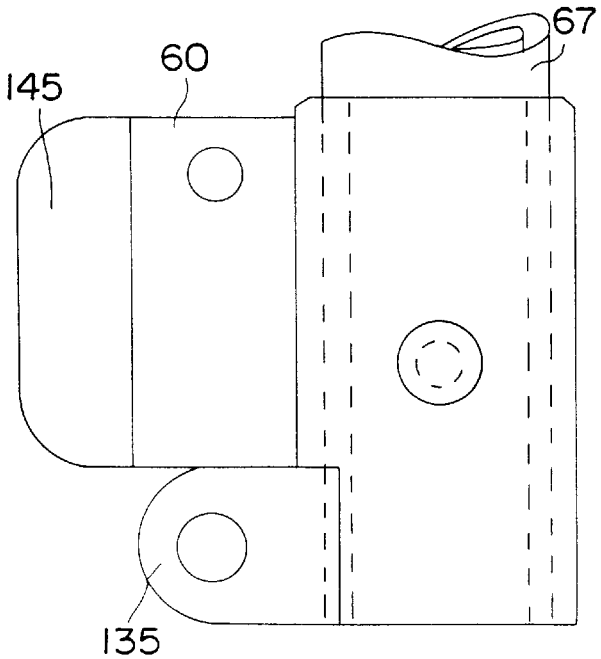
Figure 14:
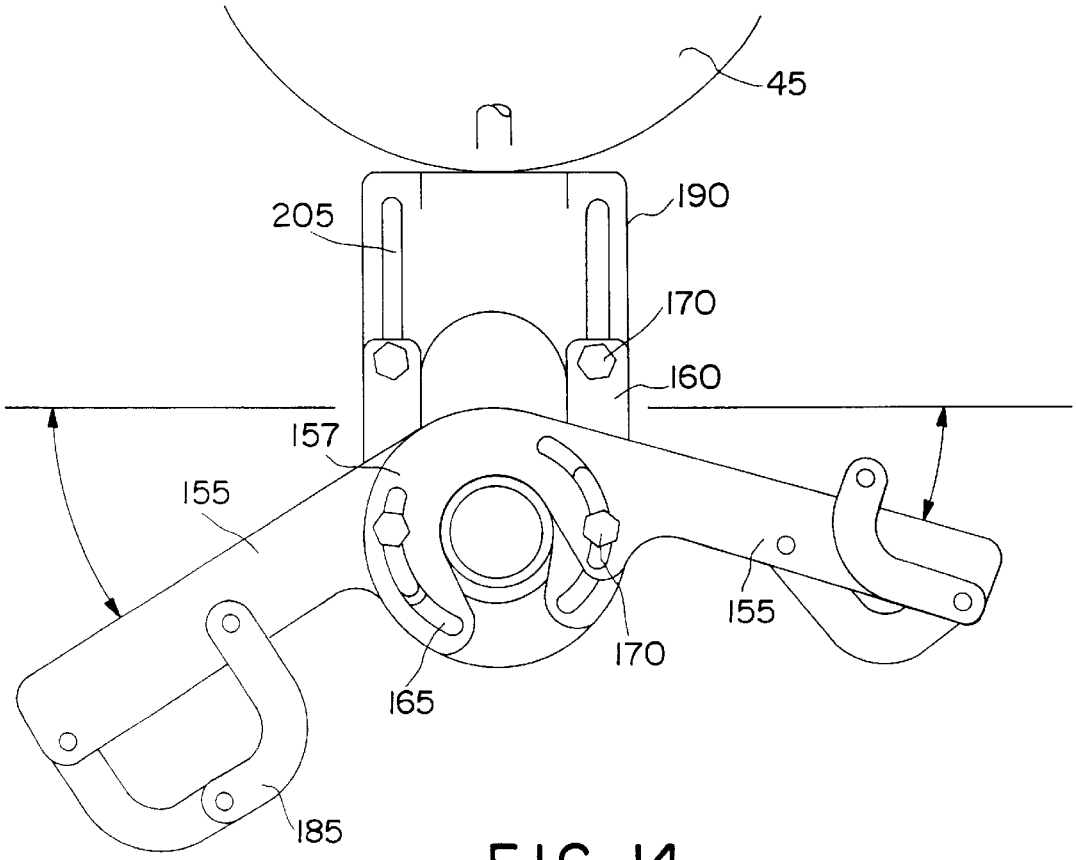
FIG. 14 is a plan view of the pole mounting bracket and operating handle locking apparatus according to the present invention.
Figure 15:
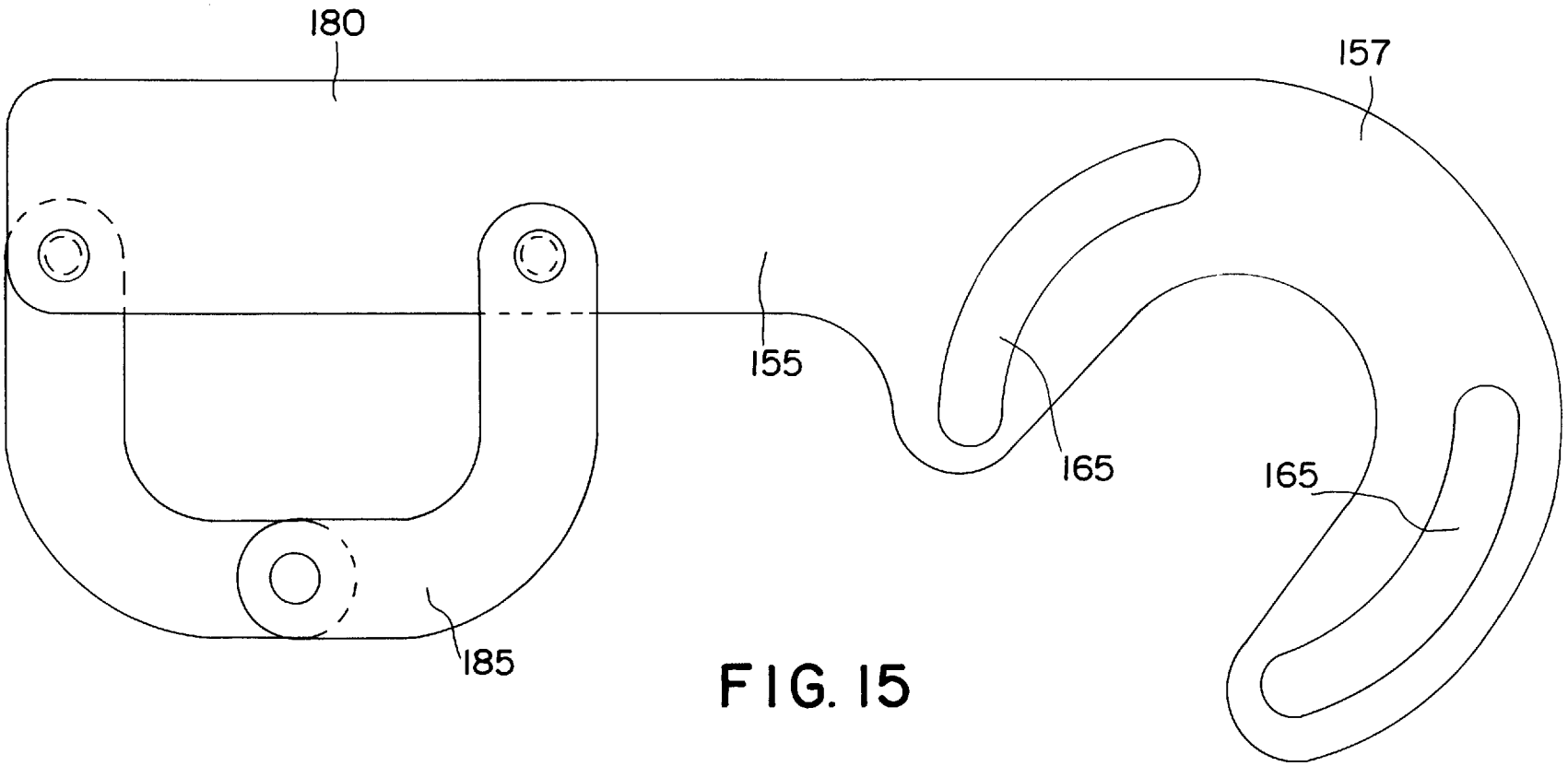
FIG. 15 is a plan view of a locking arm of the locking apparatus shown in FIG. 14.
Figure 18:
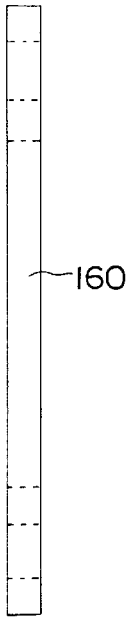
FIGS. 16–18 are a plan view, side view and front view, respectively, of a bracket of the locking apparatus shown in FIG. 14, which bracket also serves to stabilize the gang switch rotary operating shaft on the pole.
Figure 16:
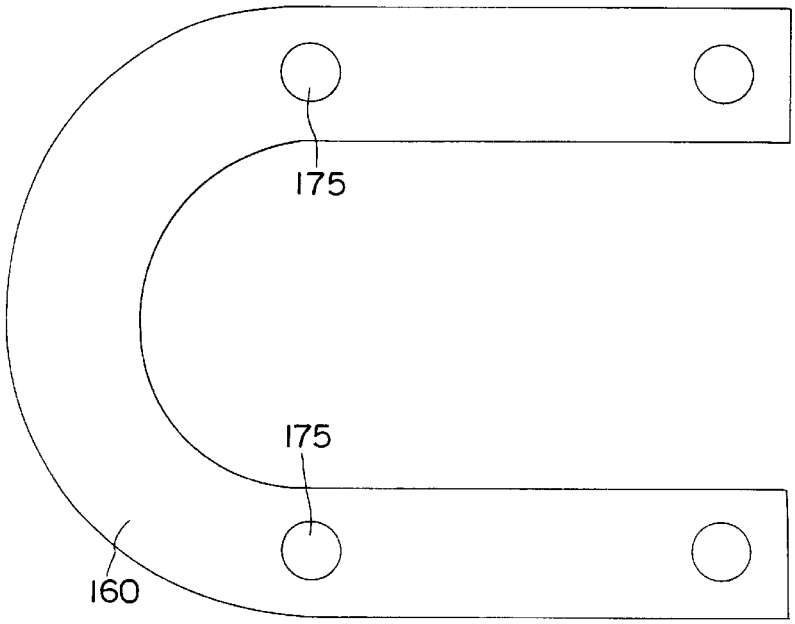
Figure 17:
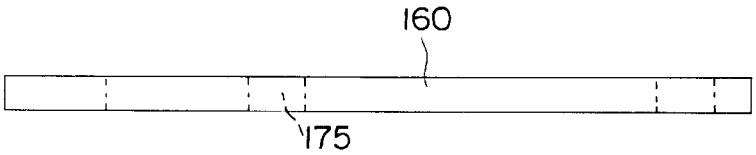
Figure 20:
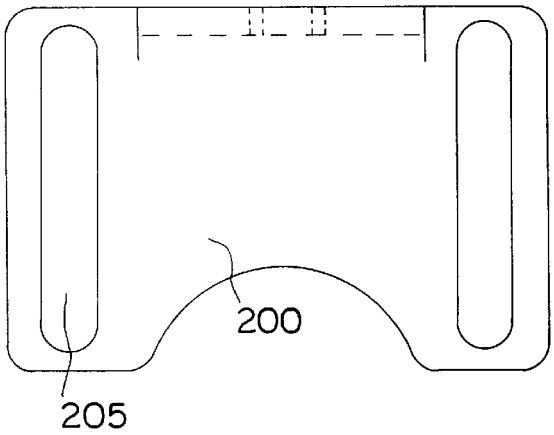
FIGS. 19–21 are a side view, plan view and rear view, respectively, of a bracket of an attachment assembly used to connect the locking apparatus shown in FIG. 14 to a pole.
Figure 21:
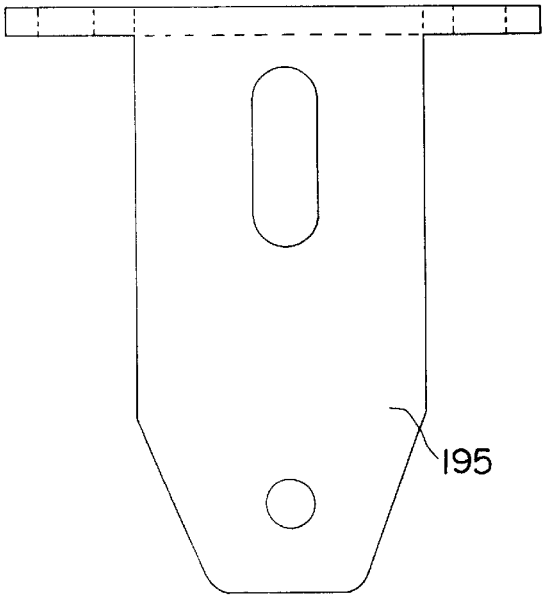
Figure 19:
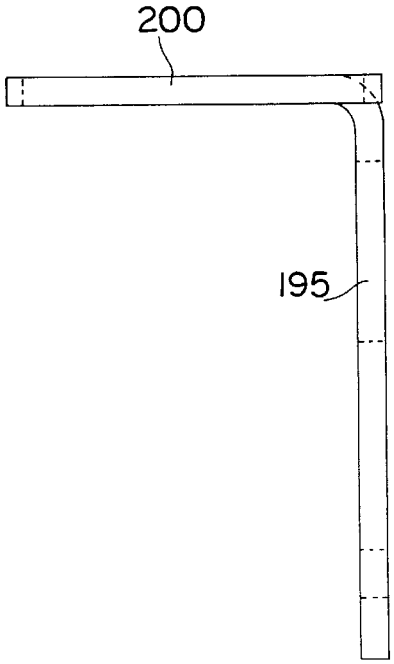

Referring to FIGS. 11–13, the components of the operating handle and clutch plate assembly 30 are shown. In particular, the clutch plate 60 is shown having a tapered front edge portion 145. The tapered front edge portion 145 helps to feed the clutch plate 60 into the two slots 120, 125, even if the two slots are not exactly aligned. Preferably, the edges of the slots are chamfered to further facilitate the feeding of the clutch plate therein.

Further, as is shown, the connecting assembly 30 includes a receiving bracket 150, that has the bracket 135 and the clutch plate 60 formed thereon. Receiving bracket 150 forms a sleeve, and receives the handle 67 therein. As shown, the handle can be riveted to the receiving bracket, or affixed thereto in another known manner.

In operation, the handle 67 will be in either an essentially vertical position, such as shown in FIGS. 1 and 2, in a plane normal to operating shaft 40' or locked in an angled position, such as shown in FIG. 3. In the position shown in FIGS. 1 and 2, the clutch plate 60 projects through the slots 120, 125, and engages the two shafts 75, 80 together. Thus, activation of the motor operator 15 will cause the gang switch 20 to either open or close. However, if the handle 67 is pivoted at the bracket 135, the clutch plate 60 will be pulled out of engagement with the two shafts 75, 80. In this position, activation of the motor operator will cause shaft 75 to rotate. However, since the shafts are no longer connected together, shaft 75 will simply rotate within shaft 80. In order to cause activation of the gang switch, the handle 67 must be rotated in a clockwise or counter-clockwise motion about the axis of the shafts 75, 80. Since handle 67 is connected via the bracket 135 and hinges 130 to the shaft 80, such rotation of the handle will likewise cause the shaft 80, 40 to rotate, and thus causing the gang switch to be either opened or closed.

As is apparent, the foregoing provides an improved apparatus for disengaging the motor operator from the gang switch, while simultaneously providing a novel assembly for manually operating the gang switch. Further, as shown in the Figures, it is readily visually apparent as to the status of the gang switch, i.e., if it is connected to the motor operator, disconnected from the motor operator, and the switch's position when it is disconnected from the motor operator.

Referring to FIGS. 3, and 14–18, the locking apparatus 35 is shown in detail. As shown, the locking apparatus 35 includes two arms 155. Each arm 155 has one end 157 connected to U-bracket 160. Each end 157 preferably has a semi-circular shape, so as to wrap around the operating shaft 40. As shown, one end 157 will lay upon the other end 157, so that only one of the ends 157 will be in direct contact with the U-bracket 160. Each end 157 further has at least one, and as shown, preferably two, arcuate-shaped slots 165 formed therein. The arcuate-shaped slots 165 receive a bolt 170, which is likewise received within a hole 175 formed within the U-bracket 160. The bolt 170 fixes the respective arm 155 to the U-bracket 160. However, because of the arcuate-shaped slot, when the bolt 170 is loosened, the arms can be pivoted about an axis of the shaft 40, towards and away from one another.

Similar to the ends 157, the U-bracket is shaped so as to partially wrap around the operating shaft 40. Preferably, the radius of curvature of the U-bracket is selected so that the U-bracket will fit around the shaft 80.

At the other end 180 of the arms 155 are located hasps 185. The hasps 185 can be opened to receive the handle 67, and are padlockable with the padlock 70 or 55 so as to lock the handle 67 in a desired position. Thus, when the handle 67 is moved to a first position, it can be locked to one of the free ends 180, and when the handle is moved to a second position, it can be locked to the other one of the free ends.

As is known in the art, different types of gang switches may require different amounts of rotational movement of the associated shaft in order to fully open or close the switch. Thus, the arms 155 are pivotable (using the arcuate slots 165) so as to place the hasps 185 in the correct locations for receiving and locking the handle 67 in position, after the handle has been used to move the switch into its opened position, and after the handle has been used to move the switch into its closed position. Stated alternatively, the ends 180 will be arranged at an angle relative to one another. Preferably this the angle is adjustable between 30 and 180 degrees. Thus, the present invention provides a locking assembly that will accommodate different types of switches.

Referring now to FIGS. 1, 14 and 19–21, the attachment assembly 50, which comprises a bracket 190 is shown. Bracket 190 is used to connect the locking apparatus to pole 45. As illustrated, the locking apparatus has essentially an L-shape profile, with one leg 195 of the L being connectable to the pole 45, and the other leg 200 of the L being connectable to the U-bracket 160.

The surface of leg 200 has two parallel slots 205 formed therein. Slots 205 are spaced away from one another so as to be in registration with the legs of the U-bracket. Slots 205 receive bolts 170, which project up through holes formed in the legs of the U-bracket. When the bolts are loosened, the locking apparatus 35 can be moved towards or away from the pole 45, depending on the operating requirements. Thus, variations in the location of the operating shaft can be accommodated for, due to usage of different motor operators.

The invention now being fully described, it will be apparent to one of ordinary skill in the art that any changes and modifications can be made thereto without departing from the spirit or scope of the invention as defined in the claims.

What is claimed is:

1. An apparatus for use with a motor operator and an overhead distribution gang switch, the motor operator being activatable for automatically opening and closing the gang switch, comprising:

a coupler assembly selectively coupling the motor operator with the gang switch;

means for locking said coupler assembly in a coupled mode;

connecting means operatively connected to said coupler assembly and cooperating with said coupler assembly for selectively coupling the motor operator with the gang switch, and for manually opening and closing the gang switch when the motor operator and the gang switch are uncoupled; and locking means engageable with said connecting means when the motor operator and the gang switch are uncoupled, for locking said connecting means in a first position in which the gang switch is opened, and locking said connecting means in a second position in which the gang switch is closed.

2. The apparatus defined in claim 1, wherein said locking means comprises first and second arms, each arm having a first end pivotally connected to one another, and each arm having a free second end arranged at an angle relative to one another.

3. The apparatus defined in claim 2, wherein said connecting means comprises a handle pivotably connected to said coupler assembly, said handle being movable to the first position whereby the handle is lockable to one of the free second ends, and being movable to the second position whereby the handle is lockable to the other one of the free second ends.

4. The apparatus defined in claim 2, wherein the angle is adjustable.

5. The apparatus defined in claim 4, wherein the angle is between 30 and 180 degrees.

6. The apparatus defined in claim 1, wherein said coupler assembly comprises a first shaft connectable to the gang switch, and a second shaft connectable to the motor operator.

7. The apparatus defined in claim 6, wherein one of said shafts comprises a sleeve having the other one of said shafts rotatably received therein.

8. The apparatus defined in claim 7, wherein each of said shafts has a slot formed therein, said slots being alignable when said shafts are rotated.

9. The apparatus defined in claim 8, wherein said connecting means includes a clutch plate movable towards and away from the slots for engagement therewith, whereby engagement of said clutch plate with the slots fixes said shafts together, so that activation of the motor operator causes a movement in the switch.

10. The apparatus defined in claim 9, wherein said connecting means further comprises a handle pivotably connected to said coupler assembly, and wherein said clutch plate is connected to said handle, said handle being pivotable towards said shafts for engaging said clutch plate with the slots, and being pivotable away from said shafts, for disengaging said clutch plate with the slots and uncoupling the motor operator from the gang switch.

11. The apparatus defined in claim 10, wherein when said clutch plate is disengaged from the slots, said handle is selectively movable to the first position and the second position.

12. The apparatus defined in claim 9, wherein said clutch plate is tapered.

13. The apparatus defined in claim 1, wherein said coupler assembly comprises a first shaft connectable to the gang switch, a second shaft connectable to the first shaft, and means for releasably attaching said second shaft to the motor operator.

14. The apparatus defined in claim 13, wherein said means for releasably attaching comprises a first flange attached to an end of said second shaft, and a second flange attached to the motor operator and being fastenable to said first flange.

15. The apparatus defined in claim 1, further comprising means for attaching the locking means to a pole.

16. The apparatus defined in claim 15, wherein said means for attaching is adjustable so as to change a distance between said locking means and the pole.

17. A lockable engagement/disengagement assembly for use between a motor operator which is connected to a first operating shaft and a gang switch which is connected to a second operating shaft, the first and second operating shafts being aligned so as to have a common axis and the gang switch having an open state or a closed state, said lockable engagement/disengagement assembly comprising:

a coupler assembly which includes a first member adapted to be connected to the first operating shaft and a second member adapted to be connected to the second operating shaft, the first member being disposed adjacent the second member and being rotatable with respect to the second member;

connecting means, including a handle which is pivotable between a first pivoted position wherein the handle is spaced apart from the common axis by a first distance and a second pivoted position wherein the handle is spaced apart from the common axis by a second distance, for connecting the first and second members when the handle is in the first pivoted position so that the second operating shaft rotates in unison with the first operating shaft and for disconnecting the first and second members when the handle is in its second pivoted position so that the second operating shaft can be manually rotated about the common axis, without rotating the first operating shaft, between an open position wherein the gang switch is in its open state and a closed position wherein the gang switch is in its closed state; and locking means for locking the handle in either its open or closed position while the handle is in its second pivoted position.

18. An apparatus for use with a motor operator and a switch, the motor operator being activatable for automatically opening and closing the switch, comprising:

a coupler assembly adapted to selectively couple the motor operator with the switch, and comprising a sleeve, and a shaft rotatably received within said sleeve, said sleeve being connectable to one of the motor operator and the switch, and said shaft being connectable to the other one of the motor operator and the switch, said sleeve and said shaft each having a slot formed therein, with the slots being alignable when the shaft is rotated relative to said sleeve; and connecting means operatively connected to said coupler assembly and including a clutch plate movable towards and away from the slots for engagement therewith, whereby engagement of said clutch plate with the slots fixes said sleeve and said shaft together, so that activation of the motor operator causes a movement in the switch, and whereby disengagement of said clutch plate from the slots allows separate rotation of both said sleeve and said shaft, so that the motor operator is uncoupled from the switch.

* * * * *